United States Patent [19]

Logan

[11] Patent Number: 4,530,690

[45] Date of Patent: Jul. 23, 1985

[54] NEWSPAPER FOLD ROLLER

[75] Inventor: Thomas L. Logan, Orland Park, Ill.

[73] Assignee: Rockwell International Corporation, Pittsburgh, Pa.

[21] Appl. No.: 542,869

[22] Filed: Oct. 17, 1983

[51] Int. Cl.[3] ..... B31F 1/10; B60B 7/00; B60B 11/00

[52] U.S. Cl. ..... 493/442; 29/119; 29/123; 29/125

[58] Field of Search ..... 29/119, 123, 124, 125, 29/130; 83/425.4, 504, 664, 665; 493/424, 425, 434, 435, 442, 443

[56] References Cited

U.S. PATENT DOCUMENTS

| | | | |
|---|---|---|---|
| 46,325 | 2/1865 | Barnard | 83/504 |
| 686,573 | 11/1901 | Bechman | 493/435 |
| 2,024,258 | 12/1935 | Tomlin et al. | 493/443 X |
| 2,752,632 | 7/1956 | Winstead | 29/119 X |
| 2,814,855 | 12/1957 | Seary et al. | 29/123 |
| 2,816,025 | 12/1957 | Dahlberg | 29/119 |
| 4,414,875 | 11/1983 | Pearson | 83/504 X |

*Primary Examiner*—E. Michael Combs

[57] ABSTRACT

An improved second fold roller for use in the folding of tabloids, the fold roller having two semicylindrical inserts having margin rings formed thereon, and having means for mounting the inserts on a base member in a manner providing for easy removal of the inserts for replacement by inserts having differently located margin rings.

3 Claims, 10 Drawing Figures

NEWSPAPER FOLD ROLLER

BACKGROUND OF THE INVENTION

Field of the Invention

The production of tabloid-style newspapers is usually accomplished by printing on normal full size travelling web, slitting this web down the center and then slitting each of these two webs so that four webs are produced. Each of the final webs is cut transversely and the resulting sheets stacked for folding only once to form a fold line only along the lefthand edge of the final product. Folding is performed by a separate folding apparatus in which a blade on a rotating cylinder creates the initial fold and pushes the folded edge into the nip of a pair of cooperating second fold rollers. One of the second fold rollers has a crusher strip mounted in the outer surface which is timed to coincide with entry of a folded edge between the fold rollers and effect permanent creasing. The roll that carries the crusher strip also has margin rings whose outer surfaces are contained in an imaginery cylinder containing the outer surface of the crusher strip. The surfaces of the margin rings and the crusher strip are knurled or roughened to provide a good grip on the paper being folded.

In the past, fold rollers having the crusher strip and margin rings have always required removal and replacement when a folder was being changed to accommodate the folding of a different size tabloid. This is a job that usually requires a full day to complete and is therefore expensive both in terms of the effort involved as well as in terms of the downtime of the folder.

SUMMARY OF THE INVENTION

It is therefore a principal object of this invention to provide an improved folder roll construction for use in a tabloid-type folder that permits changeover from the production of one size of tabloid to another in a very short time.

An additional object of this invention is to provide an improved folder roll construction having removable margin ring inserts that permit expeditious changeover from the folding of one size tabloid to another.

A further object of this invention is to provide an improved folder roll construction having changeable margin ring carrying inserts that are held in position on the roll by longitudinally adjustable means also carried on the roll.

BRIEF DESCRIPTION OF THE DRAWINGS

Other objects and advantages of this invention will be in part obvious and in part explained by the accompanying specification and drawings in which.

DESCRIPTION OF THE PREFERRED EMBODIMENT

As was mentioned above, the present invention is concerned with an improved fold roll for use on folders that are used in the production of tabloid size newspapers. In the past, when changing from one size paper to another, it has been necessary to shut down the apparatus and completely remove the second fold roll so that the distance between the margin rings could be changed. The present invention overcomes this difficulty by providing a second fold roll having an improved construction. Specifically, the roll is so shaped as to accommodate two semicylindrical portions that can be quickly removed and exchanged for similar semicylindrical portions on which the margin ring is located at some different longitudinal location along the axis of the base roller.

Figure 1:
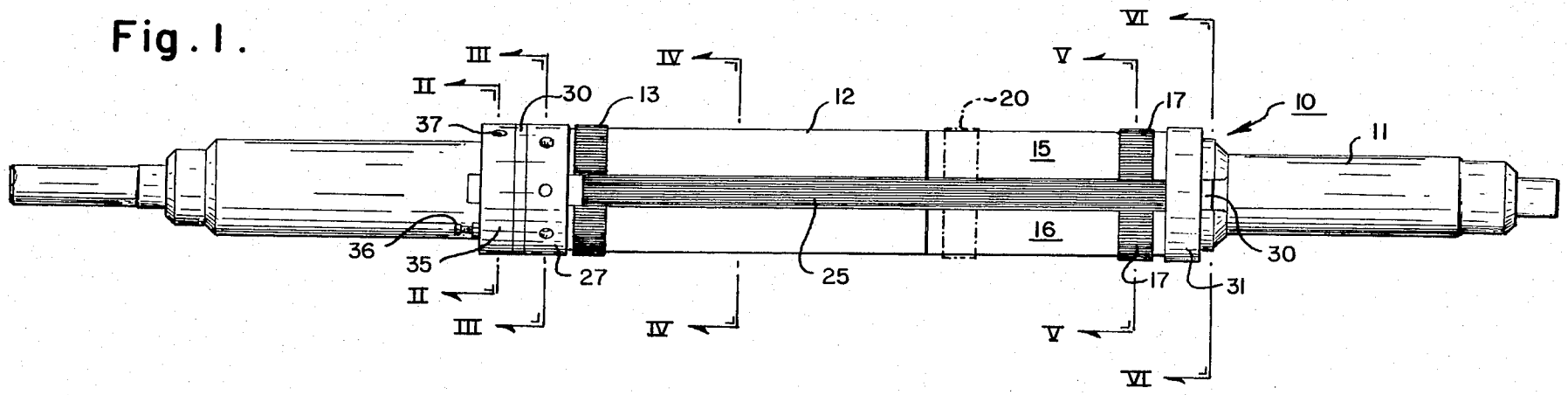
FIG. 1 is a side elevation of the improved fold roll of this invention showing removable inserts with margin rings assembled on a fold roll.

For a better understanding of the invention, reference is made to the drawings, and specifically to FIG. 1, wherein the numeral 10 indicates the general overall improved roller construction. The roller 10 is comprised of an elongated roll 11 which has an intermediate body portion 12 that is of a diameter that is larger than the diameter than any other section of the roll 11. The intermediate body portion 12 has a knurled or roughened margin ring 13 formed integrally on one end thereof, the margin ring rising above the surface of the remainder of the intermediate portion 12 so that only the exposed outer surface of margin ring 13 will grip the edges of a newspaper as it is being fed through the folding apparatus.

Figure 9:
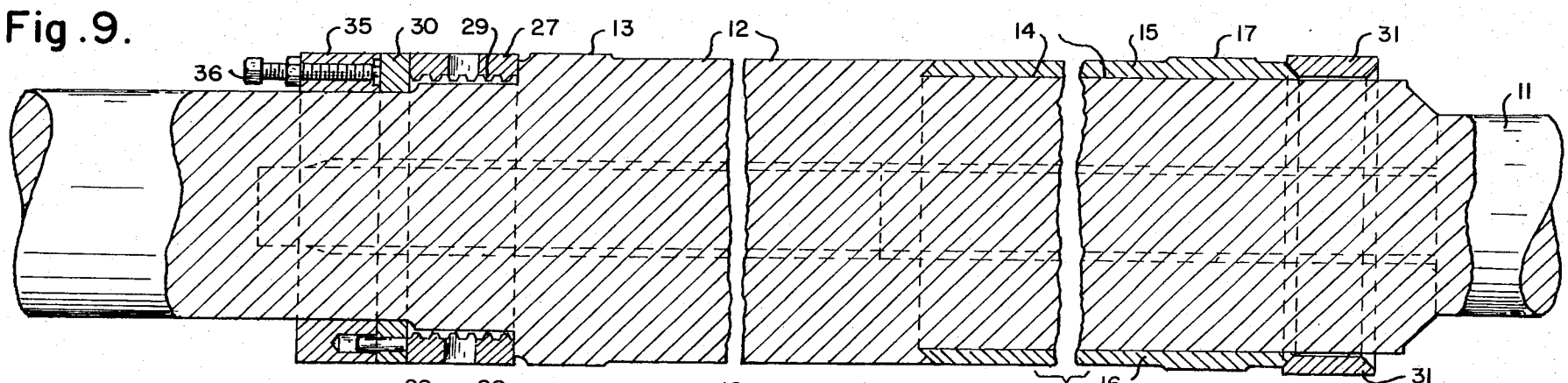
FIG. 9 is a partially sectional view taken along the line IX—IX of FIG. 7.
Figure 10:
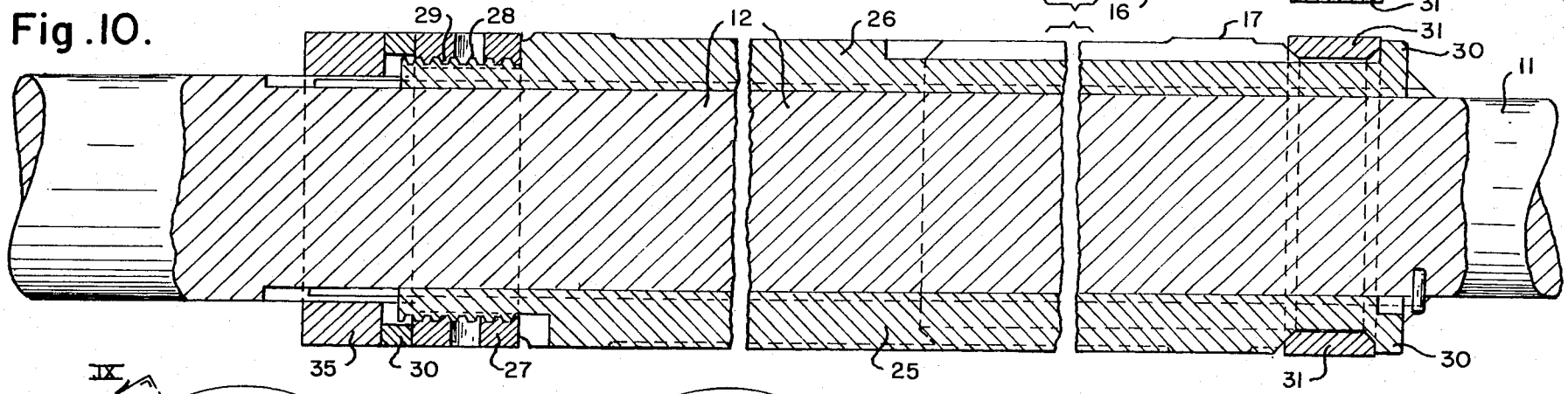
FIG. 10 is a partially sectional view taken along the line X—X of FIG. 7.
Figure 8:
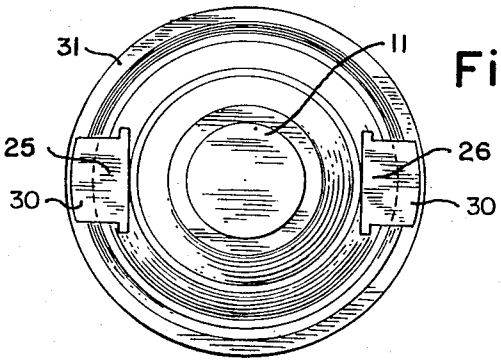
FIG. 8 is an end view of the roll of this invention looking from the right to the left of FIG. 1.
Figure 7:
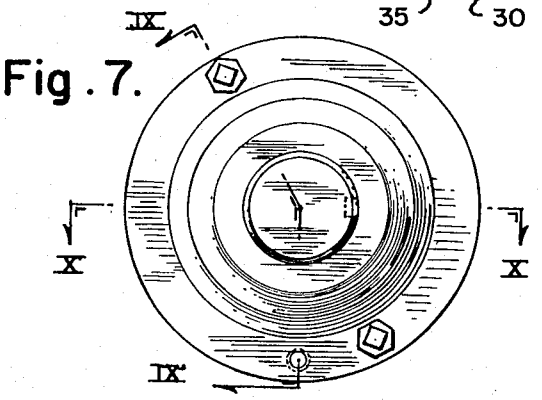
FIG. 7 is an end view of the roll of this invention looking from the left to the right of FIG. 1.

By referring to FIGS. 9 and 10 of the drawings, it can be seen that the intermediate portion 12 includes a section of reduced diameter 14 formed on that end of the intermediate body which is opposite the margin ring 13. The function of the reduced section 14 is to accommodate the reception of a pair of semicylindrical inserts 15 and 16 onto the intermediate section of reduced diameter. Each of the semicylindrical inserts has formed on its surface a margin ring 17 which when the two halves 15 and 16 are assembled on the intermediate portion 12 of roll 11, will form a circular knurled margin ring on the righthand side of the roller. It may be noted at this time that the purpose of the invention is to provide a means whereby the distance between the cooperating and opposed margin rings can be expeditously changed to accommodate different widths of tabloid newspapers. This is accomplished by loosening one set of semicylindrical inserts and replacing them with another set in which the margin rings are located at a different position along the longitudinal axis of roll 11. For example, a new pair of inserts could be inserted in which the margin ring would be located at the phantom position identified by the numeral 20 in FIG. 1 of the drawings.

Means are provided whereby the semicylindrical inserts 15 and 16 can be retained on the portion of reduced diameter 14. Broadly, these means comprise elongated means or elements that are mounted within longitudinally extending slots found in the main intermediate body portion 12 of roll 11 and adjustable means that is mounted on the elongated roll to move the elongated elements parallel to the axis of the roll shaft and thereby effect clamping and release of the inserts depending upon the direction of movement of the elongated means.

Figures 2, 3, 4, 5, 6:
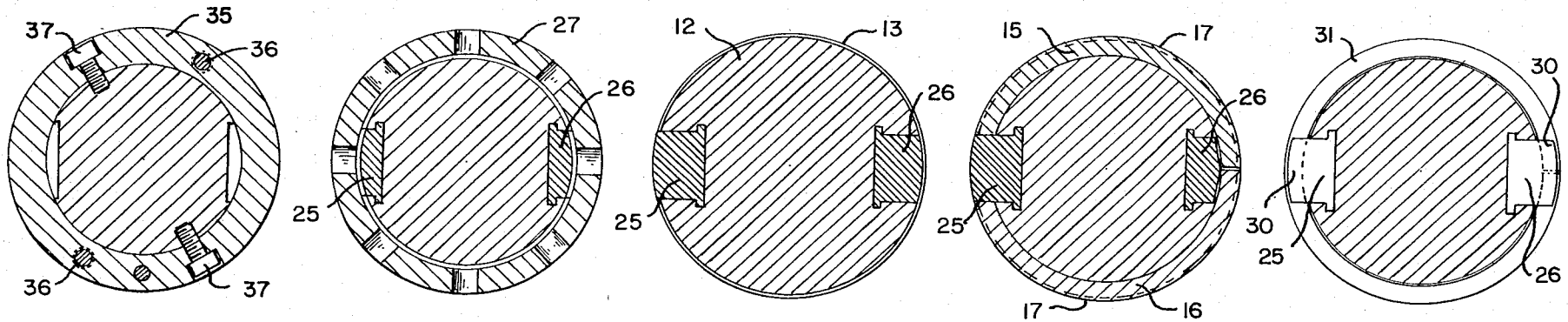
FIG. 2 is a cross section taken along the line II—II in FIG. 1.
FIG. 3 is a cross section taken along the line III—III in FIG. 1.
FIG. 4 is a cross section taken along the line IV—IV in FIG. 1.
FIG. 5 is a cross section taken along the line V—V in FIG. 1.
FIG. 6 is a cross section taken along the line VI—VI in FIG. 1.

More specifically, there are located at substantially diametrically opposite positions on the intermediate body portion 12 a pressure strip 25 and a bar clamp 26. The pressure strip 25 can be seen clearly in FIG. 1 and the bar clamp 26 can be indentified most clearly in FIGS. 3, 4 and 5 which are sectional views through the roll. As these latter figures show, most clearly, the pressure bar 25 and bar clamp 26 are received into appropriately milled recesses within the roller 11. Also, referring to FIGS. 4 and 5, it can be seen that the upper or outer surface of the pressure bar 25 extends outwardly into an imaginary cylinder that would also contain the outermost surfaces of the margin rings. The pressure bar 25 and bar clamp 26 are constructed in substantially the same fashion, with the exception that the outer surface of the bar clamp terminates substantially coterminous with the surface 12 of the main body portion. Each of these elements is formed with spiral threads on the lefthand end as viewed in FIGS. 1, 2, 9, and 10. As shown in section in FIGS. 9 and 10, the external threads 28 on the pressure bar 25 and bar clamp 26 are threadably engaged with the internal threads 29 of locking ring 27. The opposite ends of each of the elements 25 and 26 terminate in an upwardly extending flange 30 that abuts a right end locking ring 31.

Internally threaded locking ring 27 is abutted by an intermediate spacer ring 30 that in turn is abutted by a clamp ring 35. Collar clamp ring 35 includes tightening means, here shown as a bolt and nut combination 36 that is used to tighten against the spacer ring 30 and hold the locking ring 27 in its adjusted position. The clamping ring 35 is secured directly to the roll shaft by means of threaded fasteners 37 shown in the cross sectional view of FIG. 2.

In operation, when it is desired to change a set of semicylindrical inserts 15 and 16 to provide other inserts with the margin ring located at a different site, the fasteners 37 are loosened so that the clamp collar 35 can be moved backwardly along with spacer 30. This having been done, then the locking ring 27 is turned forcing the pressure bar 25 and bar clamp 26 toward the right-hand side of the drawings and thereby permitting locking ring 31 to be moved to the right and clear the end of the semicylindrical inserts. With this accomplished, the operator need only remove both of the sections and install the insert that is desired to be used. With the new inserts in position, the reverse of the operation described above is effected and the new inserts are ready for operation.

Whereas in the past, it has required approximately a day's time to effect change in a second fold roll of the type discussed here, it is possible with this invention to effect a changeover from one size tabloid to the other in no more than fifteen minutes.

Although the present invention has been described in connection with the preferred embodiments, it is to be understood that modifications and variations may be resorted to without departing from the spirit and scope of the invention, as those skilled in the art will readily understand. Such modifications and variations are considered to be within the purview and scope of the invention in the appended claims.

I claim:

1. An improved second fold roller construction for use in the production of tabloid style newspapers, said roller comprising:

(a) an elongated roll adapted to be rotatably supported in suitable supporting framework, said roll having a main intermediate body portion of larger diameter than the remainder thereof;

(b) a margin ring formed adjacent one end of said intermediate body portion and rising above the surface thereof;

(c) a section of reduced diameter formed on the end of said intermediate body portion opposite that end where said margin ring is formed;

(d) semicylindrical inserts mounted on said section of reduced diameter to increase the diameter of said section to equal that of said main intermediate body portion, said inserts having a margin ring formed thereon which rises above the surface thereof;

(e) a crushing strip slidably disposed within a longitudinally extending slot in said main intermediate body portion, said crushing strip including (i) an outer surface that would be contained in an imaginary cylinder containing the outer surface of said margin rings, (ii) an outwardly extending flange on one end and (iii) a threaded portion on the opposite end of said crushing strip from said flange;

(f) a bar clamp slidably disposed within a longitudinally extending slot in said main intermediate body portion at a location diametrically opposed to the position of said crushing strip, said bar clamp being constructed identically to said crushing strip but having its outer surface substantially coterminous with the surface of said main intermediate body portion;

(g) a locking ring mounted on said semicylindrical inserts between the margin ring and the outwardly extending flanges on said crushing strip and said bar clamp; and (h) an internally threaded locking ring threadably engaging said elongated roll shaft and the threads on said bar clamp and on said crushing strip whereby longitudinal movement of said bar clamp and said crushing strip can be effected in directions parallel to the axis of said roll shaft.

2. An improved second fold roller as defined in claim 1 wherein said means operably engaging said axially movable elements comprises:

(a) an internally threaded locking ring;

(b) a collar clamp attached to said roll shaft; and (c) an intermediate spacer ring mounted on said roll shaft between said locking ring and said collar clamp.

3. An improved second fold roller as defined in claim 2 wherein means is included in said collar clamp to lock said spacer ring in a fixed position.

* * * * *